US008083584B2

(12) United States Patent
Greiner et al.

(10) Patent No.: US 8,083,584 B2
(45) Date of Patent: Dec. 27, 2011

(54) METHOD FOR PERMITTING CANCELLATION OF A WAGER

(75) Inventors: John D. Greiner, Thousand Oaks, CA (US); Henry P. Stapp, Santa Clarita, CA (US); Jeff Franklin, Monrovia, CA (US); Ruben M. Pegorer, Beverly Hills, CA (US)

(73) Assignee: Youbet.com, LLC, Louisville, KY (US)

( * ) Notice: Subject to any disclaimer, the term of this patent is extended or adjusted under 35 U.S.C. 154(b) by 1120 days.

(21) Appl. No.: 11/279,834

(22) Filed: Apr. 14, 2006

(65) Prior Publication Data

US 2006/0247022 A1 Nov. 2, 2006

Related U.S. Application Data

(60) Provisional application No. 60/671,645, filed on Apr. 15, 2005.

(51) Int. Cl.
*A63F 9/24* (2006.01)

(52) U.S. Cl. ..... 463/25; 463/29; 463/42

(58) Field of Classification Search ..... 463/25, 463/42, 29

See application file for complete search history.

(56) References Cited

U.S. PATENT DOCUMENTS

| | | | | |
|---|---|---|---|---|
| 3,810,627 | A | 5/1974 | Levy | |
| 5,823,872 | A | 10/1998 | Prather et al. | |
| 6,099,409 | A | 8/2000 | Brenner et al. | |
| 6,183,366 | B1 | 2/2001 | Goldberg et al. | |
| 6,264,560 | B1 * | 7/2001 | Goldberg et al. | 463/42 |
| 6,443,841 | B1 * | 9/2002 | Rossides | 463/25 |
| 6,454,266 | B1 * | 9/2002 | Breeding et al. | 273/292 |
| 6,554,709 | B1 | 4/2003 | Brenner et al. | |
| 6,928,960 | B2 | 8/2005 | Carlos et al. | |
| 2001/0031656 | A1 | 10/2001 | Marshall et al. | |
| 2002/0151340 | A1 | 10/2002 | Guinn et al. | |
| 2003/0096651 | A1 | 5/2003 | Black | |
| 2003/0195841 | A1 | 10/2003 | Ginsberg et al. | |
| 2003/0224854 | A1 | 12/2003 | Joao | |
| 2004/0058731 | A1 | 3/2004 | Rossides | |
| 2004/0104845 | A1 | 6/2004 | McCarthy | |
| 2004/0229671 | A1 * | 11/2004 | Stronach et al. | 463/6 |
| 2004/0325542 | | 11/2004 | Stronach et al. | |
| 2004/0248637 | A1 | 12/2004 | Liebenberg et al. | |
| 2005/0176507 | A1 | 8/2005 | Ephrati et al. | |

* cited by examiner

*Primary Examiner* — Peter DungBa Vo
*Assistant Examiner* — Steve Rowland
(74) *Attorney, Agent, or Firm* — Howard & Howard Attorneys PLLC

(57) ABSTRACT

A computer system permitting cancellation of wagers on pending events includes a wager cancellation link, which when enabled, permits the user to cancel their wager prior to the occurrence of the pending event, such as a horse race. The wager cancellation link may be enabled for users who do not have a history of excessive cancellation of wagers, measured either by number of cancellations or by a dollar value of cancelled wagers. The wager cancellation link may also be enabled for certain events occurring at certain venues. A wager cancellation limitation disables the wager cancellation link when the limitation has been violated. The computer system credits the user's account with the value of the cancelled wager in response to cancellation of the wager.

32 Claims, 4 Drawing Sheets youbet.com

Account Statement

ACCT. BAL. $49,291 as of 01/18/05 15:57:49

Last 24 Hours Last Week Last Month Date Range Future Wagers

WAGERS from 01/17/05 to 01/18/05 Does not reflect current day phone wagers.

| DATE | TRACK | RACE | C/P | BET | POOL | BETTING NUMBERS | TOTAL | REFUND | PAYOUT |
|---|---|---|---|---|---|---|---|---|---|
| 01/18/05 | RaceTrack 1 | 1 | C | $1.00 | TRI | 1,4,6 (BOXED) | $6.00 | $0.00 | $0.00 |
| ~~01/18/05~~ | ~~RaceTrack 1~~ | ~~1~~ | ~~C~~ | ~~$20.00~~ | ~~EXA~~ | ~~3,5 (BOXED)~~ | ~~$40.00~~ | $40.00 | User Canceled |
| 01/18/05 | RaceTrack 2 | 9 | C | $1.00 | SPR | 1,4/1-9,11/3,6/1,3,4... | $126.00 | $0.00 | $0.00 |
| 01/18/05 | RaceTrack 2 | 8 | C | $5.00 | EXA | 3,5 (BOXED) | $10.00 | $0.00 | $204.00 |
| 01/18/05 | RaceTrack 2 | 8 | C | $1.00 | SPR | 3,4,7,8 (BOXED) | $24.00 | $0.00 | $0.00 |
| 01/18/05 | RaceTrack 2 | 8 | C | $500.00 | WIN | 5 | $500.00 | $0.00 | $0.00 |
| 01/18/05 | RaceTrack 2 | 8 | C | $3.00 | WIN | 3 | $3.00 | $0.00 | $11.70 |

ACCOUNT TRANSACTION from 01/17/05 to 01/18/05

| UPDATED | REQUESTED | TRANSACTION | STATUS | AMOUNT |
|---|---|---|---|---|

FIG - 4

METHOD FOR PERMITTING CANCELLATION OF A WAGER

CROSS REFERENCE TO RELATED APPLICATION

This application claims the benefit of Application Ser. No. 60/671,645 filed Apr. 15, 2005, the advantages and disclosure of which are hereby incorporated by reference.

BACKGROUND OF THE INVENTION

1. Field of the Invention

The subject invention generally relates to a method and a system for permitting cancellation of a wager placed on a pending event via a computer system.

2. Description of the Prior Art

Various systems for wagering on pending events via a computer system are well known in the prior art. Occasionally however, some participants may wish to cancel a previously placed wager prior to the occurrence of the pending event. An example of a computer system permitting wager cancellation is disclosed in U.S. Pat. No. 6,443,841 to Rossides (the '841 patent).

The '841 patent discloses a computer system and method for two individuals, referred to as a "placer" and an "acceptor" in the '841 patent, to wager on an outcome of a pending event. The placer offers the wager to the acceptor by placing terms and conditions of the wager on the computer system. The acceptor accepts the wager offered by the placer via the computer system. The computer system disclosed in the '841 patent permits cancellation of the wager by either the placer or the acceptor individually for a pre-determined period of time after the acceptor has accepted the wager, but prior to the occurrence of the pending event. After the pre-determined period of time has expired, neither the placer nor the acceptor may individually cancel the wager. Accordingly, the placer and the acceptor may cancel the wager for a pre-determined time after acceptance of the wager. However, the system disclosed in the '841 patent permits a user to abuse the cancellation option by continuously placing and then cancelling wagers, thereby frustrating and disappointing other users of the computer system who have relied on the previously placed wager. The present invention is directed at solving one or more of the problems present above.

SUMMARY OF THE INVENTION

The subject invention provides a system and a method for permitting cancellation of a wager placed on a pending event via a computer system. The system includes a computer system for storing information therein related to a plurality of users. The information stored on the computer system for each of the plurality of users may indicate a per wager dollar value limit, a total dollar value limit, a quantity limit, a total dollar amount of cancelled wagers during a pre-determined time period, a total number of wagers during the pre-determined time period, and a membership in one or more groups. A remote device is operatively connected to the computer system for receiving and transmitting information therebetween. A wager cancellation interface is displayable on the remote device. The wager cancellation interface is activatable by at least one the plurality of users for cancelling the wager when the wager cancellation interface is enabled by the computer system. The wager cancellation interface is enabled based on the information stored in the computer system that is related to the at least one of the plurality of users. The method includes the steps of: storing information in the computer system that relates to each of the plurality of users, providing the computer system with the wager cancellation interface activatable by each of the plurality of users to cancel the wager, and enabling the wager cancellation interface in the computer system for at least one of the plurality of users based on the information stored in the computer system related to the plurality of users. Enablement of the wager cancellation interface permits activation of the wager cancellation interface by at least one of the plurality of users to cancel the wager.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 is a block diagram representing a screen image showing an account statement screen indicating a current status of a user's account after a wager cancellation.

DETAILED DESCRIPTION OF THE INVENTION

Figure 1:
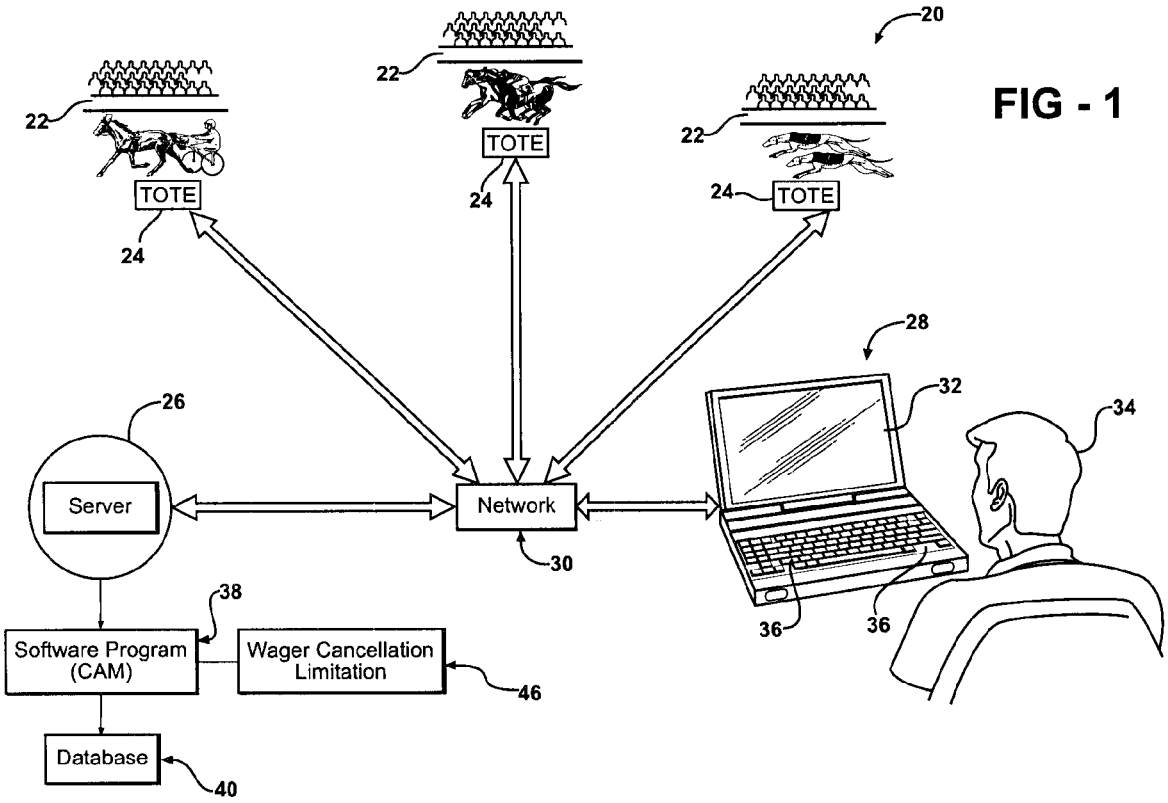
FIG. 1 is a block diagram showing a computer system.

The reference numerals shown throughout the Figures indicate corresponding parts of the subject invention shown throughout the several views. The subject invention provides a system and method for permitting cancellation of a wager placed on a pending event via a computer system. The computer system is shown generally at 20 in FIG. 1, the general operation of which is described in U.S. Published Patent Application 2005/0059495 titled "System And Method For Relaying Race Information," Ser. No. 10/940,865, filed on Sep. 14, 2004, herein incorporated by reference.

The pending event may include any event that has not yet occurred, but will typically include sporting events, such as horse or dog racing, automotive racing, football games, baseball games, hockey games, boxing matches, etc. It is also contemplated that the pending event may be a virtual reality, or simulated event. It should be understood that the above mentioned list of pending events is descriptive, and the method for permitting cancellation of the wager described herein is applicable beyond those events specifically enumerated above. The pending events will typically occur at designated venues 22, such as racetracks or stadiums. However, it should be understood that the pending event may occur at any undesignated venue as well.

In one embodiment, the computer system 20 includes at least one wager calculating system known as a totalisator, commonly abbreviated as a tote 24. It should be understood that for some events, the tote 24 is not necessary to the computer system 20 and is therefore not included. The tote 24 tracks the amount of money wagered on each entrant in each pending event occurring at each venue 22. The computer system 20 may further include at least one server generally shown at 26, at least one remote device generally shown at 28, and a communication network generally shown at 30 for operatively connecting the tote 24, the server 26, and the remote device 28. It should be understood that the server 26 may include a single server located at a central location, or may include multiple servers located at several different locations.

The remote device 28 may be implemented as a computer terminal, a personal computer, a laptop computer, a notebook computer, a personal digital assistant, a telephone, or some other suitable device. The remote device 28 includes an output interface 32 to deliver information to a user 34 and an input interface 36 for the user 34 to input commands or selections. The output interface 32 will typically include a monitor, a display, a speaker for the production of audible speech and/or other sounds, or some other suitable device. The input interface 36 may include a keyboard, keypad, mouse, touch-screen, a microphone for the reception of audible speech and/or other sounds, or some other suitable device. The remote device 28 allows the user 34, via the input interface 36 and the output interface 32, to place and cancel wagers over the computer system 20.

The communication network 30 may transmit data between the tote 24, the server 26, and the remote device 28 by either a hard-wired connection, a wireless connection, or a combination of hard-wired and wireless connections. Examples of networks 30 with hard-wired connections include, but are not limited to, the plain-old telephone service (POTS), fiber-optic communications, Ethernet, and the Internet. Examples of networks 30 with wireless connections include, but are not limited to cellular telephone networks, personal communication system (PCS) networks, Wi-Fi networks, or Bluetooth.

The computer system 20 further provides a customer account manager (CAM) implemented in a software program generally shown at 38 and operable on the computer system 20 by each of the plurality of users 34. The CAM, via the software program 38, manages a financial account and the wagers associated with each individual user of the plurality of users 34. A database is generally shown at 40, and is operatively connected with the CAM. The database 40 may include a structured query language (SQL) server, or some other suitable database. The database 40 stores information related to each individual user 34, the financial account of each individual user 34, and the plurality of venues 22. Other suitable information may also be stored on the database 40.

The information stored in the database 40 of the computer system 20 relating to each of the plurality of users 34 may include any one of, or a combination of a per wager dollar value limit, a total dollar value limit, a quantity limit, a total dollar amount of cancelled wagers during a pre-detrained time period, and a total number of wagers during the pre-determined time period, for each of the plurality of users 34. Additionally, a membership of each of the plurality of users 34 in one or more of a pre-determined group of users is also stored in the computer system. A set of rules determines which limit applies to each of the plurality of users if more than one limit is stored in the computer system 20. Additional information is stored in the database 40 of the computer system, which relates to each of the plurality of venues 22, e.g., racetracks, and may include any one of, or a combination of each pending event occurring at each of the plurality of racetracks; and whether cancellation of wagers is permissible at each of the plurality of venues 22 and for each pending event occurring at each of the plurality of venues 22. It should be understood that other information related to the plurality of users 34 and the plurality of venues 22 may be stored in the computer system 20; and that some of the information may relate to both the plurality of users 34 and the plurality of venues 20, such as a specific venue 22 that one of the plurality of users 34 frequents.

Figure 2:
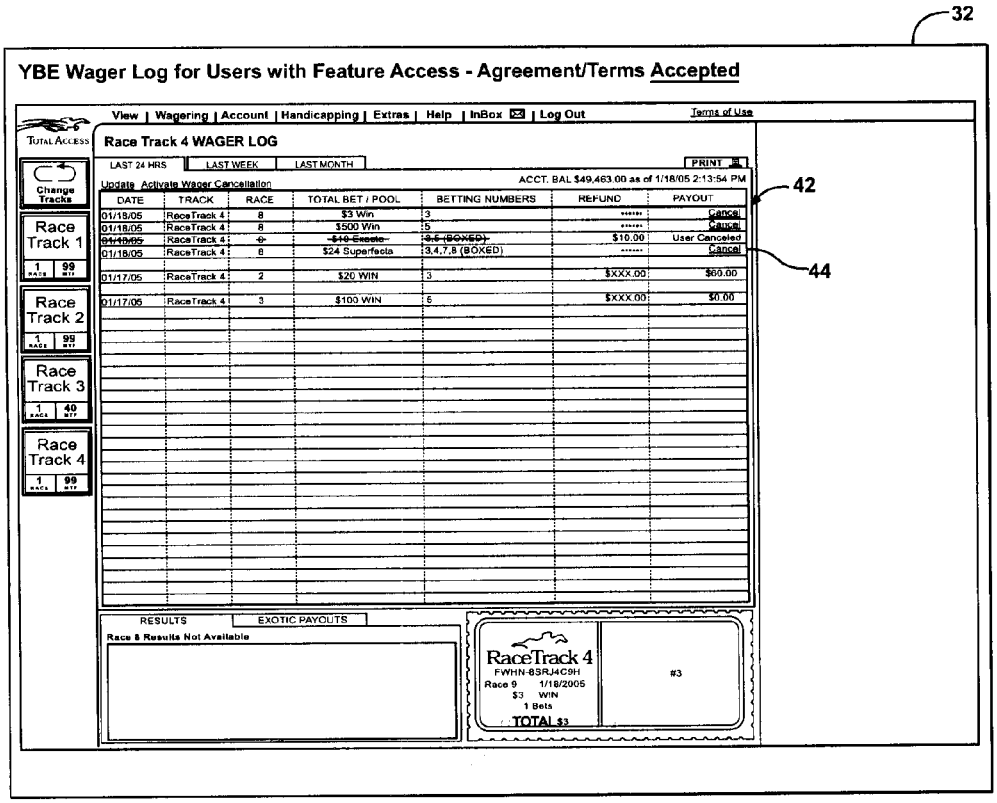
FIG. 2 is a block diagram representing a screen image showing a wager log in which a wager cancellation interface is enabled.

Referring to FIG. 2, a wager cancellation interface, generally shown at 42, is enabled based on the information stored in the database 40 of the computer system 20. The wager cancellation interface 42 may be enabled based on the information relating to the plurality of venues 22. Alternatively, the wager cancellation interface 42 may be enabled based on the information related to the plurality of users 34 (or an individual user 34). The wager cancellation interface 42 includes a wager cancellation link 44 provided by the program 38, through the CAM, and is operatable via the input interface 36 of the remote device 28. The link 44 may include an internet type control, a button on a compiled application, a speaker command, a keypad button sequence, or some other suitable control. Enablement of the wager cancellation interface 42 permits the individual user 34 to activate the wager cancellation interface 42 to cancel the wager. Accordingly, the wager cancellation interface 42 may be enabled for a user 34 who does not have an extensive history of cancelling wagers, and that user 34 may be permitted to cancel pending wagers. It is also contemplated that it may be desirable to enable (or disable) the wager cancellation interface 42 for all pending events occurring at an individual venue 22, or for specific events occurring at an individual venue 22. Accordingly, the wager cancellation interface 42 may be enabled for a user 34 wishing to cancel a wager placed on a pending event occurring at a specific venue 22. It should be understood that other criteria related to the plurality of users 34 and the plurality of venues 22 may be stored in the database 40 of the computer system 20, and used to determine whether the wager cancellation interface 42 is enabled for any individual user 34, event and/or the venue 22.

Figure 3:
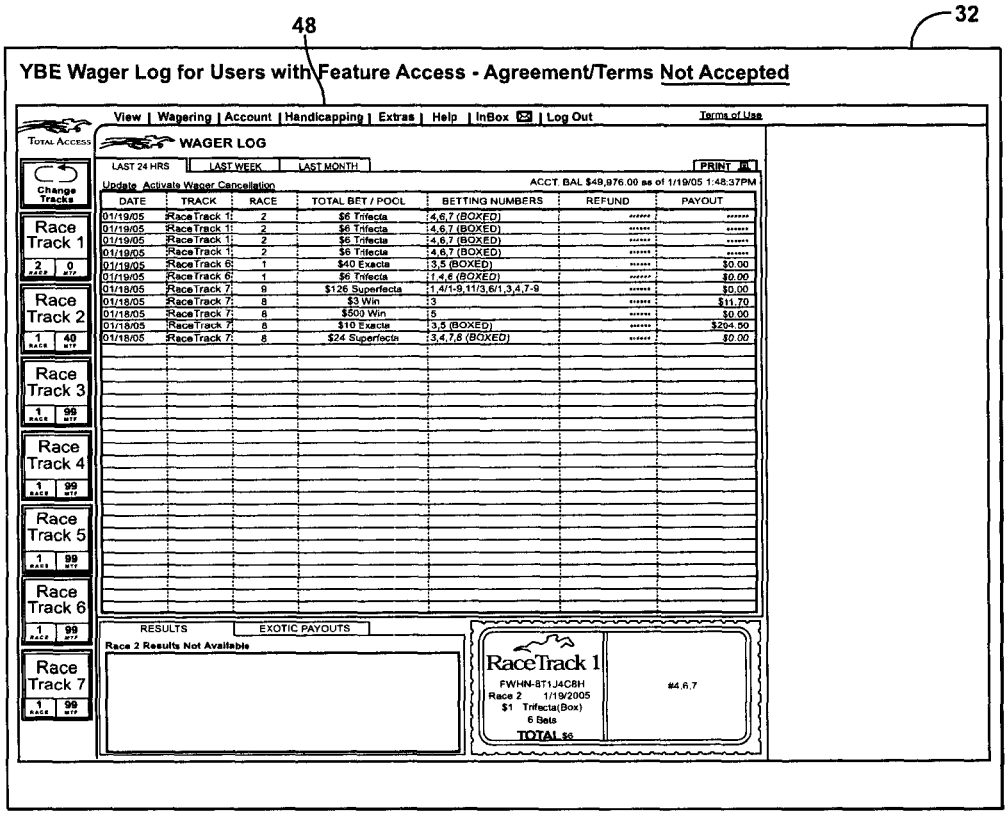
FIG. 3 is a block diagram representing a screen image showing a wager log screen in which a wager cancellation interface is not enabled.

Referring back to FIG. 1, the program 38 provides a wager cancellation limitation, generally shown at 46, to determine whether the wager cancellation interface 42 is activatable, and therefore determines the ability of the plurality of users 34 to cancel the wager after the wager cancellation interface 42 has been enabled for an individual user 34. The wager cancellation limitation 46 may be based on the information stored in the computer system 20 for each of the plurality of users related to at least one of the per wager dollar value limit, the total dollar value limit, the quantity limit, the total dollar amount of cancelled wagers during the pre-determined time period limit, and the total number of all wagers during the pre-determined time period limit. A set of priority rules determine which limit applies to each of the plurality of users if there are multiple limits stored in the computer system 20. The wager cancellation limitation 46 prevents cancellation of the wager, when the wager cancellation interface 42 is enabled, after the user 34 violates or exceeds the wager cancellation limitation 46. Accordingly, as shown in FIG. 3, a user 34 who violates the wager cancellation limitation 46 by cancelling too many wagers may be prevented from cancelling any additional wagers for the remainder of the pre-determined time period, even though the wager cancellation interface 42 is enabled in the computer system 20. In other words, the wager cancellation limitation 46, when violated, disables the wager cancellation interface 42, preventing the user 34 from cancelling any wagers for the remainder of the pre-determined time period. The wager cancellation interface 42 may still be visible by the output interface 32, even when the wager cancellation limitation 46 has been disabled by the wager cancellation interface 42. It should be understood that the wager cancellation limitation 46 may be based on other criteria than specifically listed herein.

Referring to FIGS. 2 and 3, the CAM, via the program 38 may display a wager log 48 for each of the plurality of users 34 to indicate a current status of each wager placed by individual users 34 and the account of that user 34. The wager log 48 includes the wager cancellation interface 42 and the wager cancellation link 44, activatable by the user 34 to cancel the wager. In response to activation of the wager cancellation link 44 by one of the plurality of users 34, the program 38 may display an agreement message (not shown) via the output interface 32 of the remote device 28 to indicate the terms and conditions required for cancellation of wagers. The program 38 further includes an acceptance link (not shown) activatable by the user 34 to accept the agreement message. In response to activation of the acceptance link by the user 34, the program 38 displays a confirmation message (not shown) via the output interface 32 of the remote device 28. The confirmation message may indicate cancellation of the wager, an inability to cancel the wager (such as when the wager cancellation interface 42 is not enabled), or that the wager cancellation is not verified (i.e., the wager cancellation has not yet been completed). As shown in FIG. 2, the program 38 then adjusts the account of the user 34 to credit the account of the user 34 with an amount of the cancelled wager in response to cancellation of the wager. The program 38 then updates the wager log 48 of the user 34 in response to cancellation of the wager to indicate the current status of the wager and a current value of the adjusted account of the user 34. For example, a cancelled wager may be shown with a red line drawn through the wager, as well as indicating in a payout interface that the wager was cancelled.

The foregoing invention has been described in accordance with the relevant legal standards; thus, the description is exemplary rather than limiting in nature. Variations and modifications to the disclosed embodiments may become apparent to those skilled in the art and do come within the cope of the invention. Accordingly, the scope of legal protection afforded this invention can only be determined by studying the following claims.

What is claimed is:

1. A method for permitting cancellation of wagers via a computer system, said method comprising the steps of:

storing information in the computer system related to each of a plurality of users;

allowing one of the plurality of users to place a wager on a pending event via the computer system;

providing a wager cancellation interface;

enabling the wager cancellation interface for the one of the plurality of users based on the information stored in the computer system related to the one of the plurality of users, the wager cancellation interface for allowing the one of the plurality of users to cancel the wager; and providing a wager cancellation limitation operable by the computer system to automatically prevent cancellation of the wager, by the user, after the user violates the wager cancellation limitation, the wager cancellation limitation being based on at least one of a dollar amount of all previously wagers canceled by the user during a predetermined time period or a total number of all previously wagers canceled by the user during the predetermined time period.

2. A method as set forth in claim 1 wherein the wager cancellation limitation is based on the information stored in the computer system related to each of the plurality of users.

3. A method as set forth in claim 1 wherein said step of storing information related to each of a plurality of users is further defined as storing information related to each of the plurality of users including at least one of a per wager dollar value limit, a total dollar value limit, a quantity limit, a total dollar amount of canceled wagers during a predetermined time period limit, and a total number of wagers during the predetermined time period limit.

4. A method as set forth in claim 1 wherein said step of storing information related to each of a plurality of users is further defined as storing information related to each of the plurality of users including membership of each of the plurality of users in a predetermined group of users.

5. A method as set forth in claim 1 further comprising a step of storing information in the computer system related to a plurality of venues.

6. A method as set forth in claim 5 wherein said step of storing information related to each of a plurality of venues is further defined as storing information related to each of the plurality of venues including each pending event occurring at one of the plurality of venues.

7. A method as set forth in claim 5 wherein said step of storing information related to each of a plurality of venues is further defined as storing information related to each of the plurality of venues including the permissibility of canceling wagers at each of the plurality of venues.

8. A method as set forth in claim 5 wherein said step of storing information related to each of a plurality of venues is further defined as storing information related to each of the plurality of venues including the permissibility of canceling wagers for each pending event occurring at one of the plurality of venues.

9. A method as set forth in claim 5 wherein said step of enabling the wager cancellation interface is further defined as enabling the wager cancellation interface based on information stored in the computer system related to one of the plurality of venues.

10. A method as set forth in claim 5 further comprising a step of providing a program operable on the computer system by any of the plurality of users to manage the wager of that user and an account of that user.

11. A method as set forth in claim 10 wherein said step of providing a wager cancellation interface is further defined as providing the program with a wager cancellation link selectable by each of the plurality of users to cancel the wager.

12. A method as set forth in claim 11 further comprising a step of displaying an agreement message in response to activation of the wager cancellation link by one of the plurality of users to indicate the terms and conditions for the user to cancel the wager.

13. A method as set forth in claim 12 further comprising a step of providing the program with an acceptance link activatable by the user to accept the wager cancellation agreement message to cancel the wager.

14. A method as set forth in claim 13 further comprising a step of displaying a confirmation message in response to activation of the acceptance link by the user to indicate cancellation of the wager.

15. A method as set forth in claim 14 further comprising a step of displaying a wager log to each of the plurality of users to indicate a status of the wager and the account of the user.

16. A method as set forth in claim 15 further comprising a step of adjusting the account of the user to credit the account of the user in response to cancellation of the wager with the amount of the canceled wager.

17. A method as set forth in claim 16 further comprising a step of updating the wager log of the user in response to cancellation of the wager to indicate a current status of the wager and a value of the adjusted account of the user.

18. A method for permitting cancellation of wagers on a pending event occurring at one of a plurality of venues via a computer system, said method comprising the steps of:

storing information in the computer system related to the plurality of venues;

allowing one of a plurality of users to place a wager on the pending event via the computer system;

providing a wager cancellation interface;

enabling the wager cancellation interface for the one of the plurality of users based on the information stored in the computer system related to at least one of the plurality of venues to permit cancellation of the wager, the wager cancellation interface for allowing the one of the plurality of users to cancel the wager; and providing a wager cancellation limitation to automatically prevent cancellation of the wager, by the one of the plurality of users, after the one of the plurality of users violates the wager cancellation limitation, the wager cancellation limitation being based on at least one of a total number of all previously canceled wagers during a predetermined time period or a dollar amount of all previously canceled wagers during the predetermined time period.

19. A method for permitting cancellation of a wager placed by one of a plurality of users on a pending event occurring at one of a plurality of venues via a computer system, said method comprising the steps of:

storing information in the computer system related to the plurality of venues;

allowing the one of a plurality of users to make a wager on the pending event;

providing a wager cancellation interface;

enabling the wager cancellation interface for the one of the plurality of users based on the information stored in the computer system related to at least one of the plurality of venues, the wager cancellation interface for allowing the one of the plurality of users to cancel the wager; and providing a wager cancellation limitation to automatically prevent cancellation of the wager, by the one of the plurality of users, after the one of the plurality of users violates the wager cancellation limitation, the wager cancellation limitation being based on at least one of a per wager dollar value limit, a total dollar value limit, a quantity limit, a total dollar amount of wagers canceled by the one of the plurality of users during a pre-determined time period limit, and a total number of wagers during the pre-determined time period.

20. A method as set forth in claim 18 wherein said step of storing information in the computer system related to a plurality of venues is further defined as storing information in the computer system relating to a plurality of venues including information related to each pending event occurring at one of the plurality of venues.

21. A method as set forth in claim 18 wherein said step of storing information in the computer system related to a plurality of venues is further defined as storing information in the computer system related to a plurality of venues including the permissibility of canceled wagers at each of the plurality of venues.

22. A method as set forth in claim 18 wherein said step of storing information in the computer system related to a plurality of venues is further defined as storing information in the computer system related to a plurality of venues including the permissibility of canceled wagers for each pending event occurring at one of the plurality of venues.

23. A method as set forth in claim 18 further comprising a step of providing a program operable on the computer system by any of the plurality of users to manage the wager of that user and an account of that user.

24. A method as set forth in claim 23 wherein said step of providing a wager cancellation interface is further defined as providing the program with a wager cancellation link selectable by each of the plurality of users to cancel the wager.

25. A method as set forth in claim 24 further comprising a step of displaying an agreement message in response to activation of the wager cancellation link by one of the plurality of users to indicate the terms and conditions for the user to cancel the wager.

26. A method as set forth in claim 25 further comprising a step of providing the program with an acceptance link activatable by the user to accept the wager cancellation agreement message to cancel the wager.

27. A method as set forth in claim 26 further comprising a step of displaying a confirmation message in response to activation of the acceptance link by the user to indicate cancellation of the wager.

28. A method for canceling a wager placed by users on races conducted at one of a plurality of venues via a computer system, said method comprising the steps of:

providing a program operable on the computer system by each of the users to manage the wager and an account of each of the users;

storing information in the computer system related to each of the users including at least one of a per wager dollar value limit, a total dollar value limit, a quantity limit, a total dollar amount of canceled wagers during a predetermined time period limit, and a total number of wagers during the predetermined time period and membership of each of the users in a predetermined group of users;

storing information in the computer system related to each of the plurality of venues including each pending event occurring at one of the plurality of venues and the permissibility of canceling wagers at each of the plurality of venues and for each pending event occurring at one of the plurality of venues;

allowing one of the users to place a wager on a race;

displaying a wager log for each of the users to indicate a status of the wager and the account of the user;

providing the wager log with a wager cancellation interface including a wager cancellation link;

enabling the wager cancellation interface based on the information stored in the computer system related to at least one of the plurality of venues and the plurality of users to permit cancellation of the wager, the wager cancellation interface for allowing the one of the users to cancel the wager;

providing a wager cancellation limitation for at least one of the users based on at least one of the dollar value of all previously canceled wagers, by the one user, and the total number of all previously canceled wagers, by the one user, during a predetermined period of time and operable by the computer system to automatically prevent cancellation of the wager after the one user violates the wager cancellation limitation;

displaying an agreement message in response to activation of the wager cancellation link by the one user to indicate the terms and conditions for the user to cancel the wager;

providing the program with an acceptance link activatable by the user to accept the wager cancellation agreement message to cancel the wager;

displaying a confirmation message in response to activation of the acceptance link by the user to indicate cancellation of the wager;

adjusting the account of the user to credit the account of the user in response to cancellation of the wager with an amount of the canceled wager;

updating the wager log of the user in response to cancellation of the wager to indicate a current status of the wager and a current value of the adjusted account of the user.

29. A system for canceling a wager placed on a pending event, said system comprising:

a computer system for storing information therein related to a plurality of users including at least one of a per wager dollar value limit, a total dollar value limit, a quantity limit, a total dollar amount of canceled wagers during a predetermined time period limit, and a total number of wagers during the predetermined time period limit;

a remote device operatively connected to said computer system for receiving and transmitting information therebetween and for allowing one of the plurality of users to place a wager on the pending event;

a wager cancellation interface displayable on said remote device and activatable by the one of the plurality of users, the wager cancellation interface for allowing the one of the plurality of users to cancel the wager when enabled by said computer system based on the information stored thereon related to the at least one of the plurality of users; and a program operable on said computer system for managing the wager and an account of the at least one of the plurality of users, said program including a wager cancellation limitation for disabling the wager cancellation interface after the at least one of the plurality of users violates the wager cancellation limitation, said wager cancellation limitation including at least one of a dollar amount of all previously canceled wagers during a predetermined time period or a total number of all previously canceled wagers during a predetermined time period.

30. A system for canceling a wager placed on a pending event, said system comprising:

a computer system for storing information therein related to a plurality of users including at least one of a per wager dollar value limit, a total dollar value limit, a quantity limit, a total dollar amount of canceled wagers during a predetermined time period limit, and a total number of wagers during the predetermined time period limit;

a remote device operatively connected to said computer system for receiving and transmitting information therebetween and for allowing one of the plurality of users to place a wager on the pending event;

a wager cancellation interface displayable on said remote device and activatable by at least one of the plurality of users for canceled the wager when enabled by said computer system based on the information stored thereon related to the at least one of the plurality of users; and a program operable on said computer system for managing the wager and an account of the one of the plurality of users, said program including a wager cancellation limitation for automatically disabling the wager cancellation interface after the at least one of the plurality of users violates the wager cancellation limitation, said wager cancellation limitation including at least one of the per wager dollar value limit, the total dollar value limit, a quantity limit, the total dollar amount of wagers canceled during the predetermined time period limit, and the total number of wagers during the predetermined time period limit.

31. A system for canceling a wager placed on a pending event, said system comprising:

a computer system for storing information therein related to a plurality of venues including each wagering event occurring at one of the plurality of venues and the permissibility of canceling wagers at each of the plurality of venues and for each wagering event occurring at one of the plurality of venues;

a remote device operatively connected to said computer system for receiving and transmitting information therebetween;

a wager cancellation interface displayable on said remote device and activatable by at least one of a plurality of users for canceling the wager when enabled by said computer system based on the information stored thereon related to the plurality of venues; and a program operable on said computer system for managing the wager and an account of the at least one of the plurality of users, said program includes a wager cancellation limitation for automatically disabling the wager cancellation interface after the at least one of the plurality of users violates the wager cancellation limitation, said wager cancellation limitation including a least one of a dollar amount of all previously canceled wagers during a predetermined time period or a total number of all previously canceled wagers during a predetermined time period.

32. A system for canceling a wager placed on a pending event, said system comprising:

a computer system for storing information therein related to a plurality of venues including each wagering event occurring at one of the plurality of venues and the permissibility of canceling wagers at each of the plurality of venues and for each wagering event occurring at one of the plurality of venues;

a remote device operatively connected to said computer system for receiving and transmitting information therebetween;

a wager cancellation interface displayable on said remote device and activatable by at least one of a plurality of users for canceling the wager when enabled by said computer system based on the information stored thereon related to the plurality of venues; and a program operable on said computer system for managing the wager and an account of the at least one of the plurality of users, said program includes a wager cancellation limitation for automatically disabling the wager cancellation interface after the at least one of the plurality of users violates the wager cancellation limitation, said wager cancellation limitation includes at least one of the per wager dollar value limit, the total dollar value limit, a quantity limit, the total dollar amount of wagers canceled during the predetermined time period limit, and the total number of wagers during the predetermined time period limit.

* * * * *